US006077204A

United States Patent [19]

Dickinson, Jr.

[11] Patent Number: 6,077,204

[45] Date of Patent: Jun. 20, 2000

[54] FOCUS PAD HOLDER FOR MARTIAL ARTS PRACTICE

[76] Inventor: George S. Dickinson, Jr., 150 Davis St., Deatsville, Ala. 36022

[21] Appl. No.: 09/100,029

[22] Filed: Jun. 19, 1998

Related U.S. Application Data

[60] Provisional application No. 60/050,198, Jun. 19, 1997.

[51] Int. Cl.[7] ..... A63B 69/34

[52] U.S. Cl. ..... 482/83; 482/85; 482/86; 482/87; 473/441; 473/444; 269/131; 269/132; 269/287

[58] Field of Search ..... 482/83, 84, 85, 482/86, 87, 89, 90; D21/798; 473/441, 442, 443, 444, 445; 269/131, 132, 287

[56] References Cited

U.S. PATENT DOCUMENTS

| | | | |
|---|---|---|---|
| D. 356,127 | 3/1995 | Mara . | |
| 547,731 | 10/1895 | MacLearn | 482/83 |
| 1,007,311 | 10/1911 | Pons . | |
| 1,199,278 | 9/1916 | Koch . | |
| 3,427,021 | 2/1969 | Donato | 482/85 |
| 4,093,212 | 6/1978 | Jacques . | |
| 4,319,748 | 3/1982 | Alter . | |
| 4,662,630 | 5/1987 | Dignard . | |
| 4,807,871 | 2/1989 | Bryson . | |
| 5,135,445 | 8/1992 | Christensen et al. | 482/10 |
| 5,277,679 | 1/1994 | Wells . | |
| 5,464,377 | 11/1995 | Beeman . | |
| 5,509,875 | 4/1996 | Moretti . | |
| 5,702,327 | 12/1997 | Fullbright | 482/83 |
| 5,863,279 | 1/1999 | Pouliot | 482/83 |

FOREIGN PATENT DOCUMENTS

| | | |
|---|---|---|
| 0 557 264 A2 | 8/1993 | European Pat. Off. . |
| 1655524 A1 | 6/1991 | U.S.S.R. . |
| 1694167 A1 | 11/1991 | U.S.S.R. . |
| 94/11068 | 5/1994 | WIPO . |

*Primary Examiner*—Richard J. Apley
*Assistant Examiner*—Tam Nguyen
*Attorney, Agent, or Firm*—Richard C. Litman

[57] ABSTRACT

A martial arts practice apparatus which supports a hand-held striking target, called a focus pad, in a variety of positions corresponding to parts of a person's body. The apparatus generally comprises an arm adapted to hold a focus pad at its distal end and a base which pivotally supports the arm and absorbs the force of the blows delivered to the focus pad. An axle disposed through the middle of the base and the bottom end of the arm allows the arm to be pivoted over the base, and a removable pin may be inserted through the arm and one of the holes formed at regular intervals through the top edge of the base at a uniform radial distance from the axle to secure the arm in a fixed position. A spring loaded resistance system or a resilient top portion of the base allows the base to absorb the force of the blows delivered to the focus pad.

10 Claims, 7 Drawing Sheets

FOCUS PAD HOLDER FOR MARTIAL ARTS PRACTICE

CROSS-REFERENCE TO RELATED APPLICATION

This application claims the benefit of U.S. Provisional patent application Ser. No. 60/050,198, filed Jun. 19, 1997.

BACKGROUND OF THE INVENTION

1. Field of the Invention

The present invention relates to a martial arts practice device. More specifically, the present invention relates to a martial arts practice device which adjustably supports a striking pad over a resilient base and which is adapted to absorb the force of the blow delivered to the pad.

2. Description of Related Art

For practitioners of the martial arts, it is desirable to develop a great deal of speed and accuracy in punching and kicking. One common way of developing these skills is to have a partner hold up a striking target having a handle, often called a focus pad, in various positions while the person practicing attempts to kick or punch the target. While this is generally effective, the necessity of having a partner to hold up the focus pad can be an inconvenience.

In order to avoid this problem, several devices which support a striking target to allow a person to develop their martial art skills have been disclosed in the related art. These have included a variety of wall mounted and freestanding devices which utilize a variety of means to resiliently support a striking target in a fixed or adjustable position.

U.S. Pat. No. 5,277,679, issued Jan. 11, 1994 to Ray L. Wells, discloses a martial arts practice apparatus having a target pad mounted on a horizontally extending arm which may be removably secured to a vertical shaft at several vertical increments. The shaft is rotatably supported by a base which houses a spring loaded resistance system that returns the shaft and target pad back to their original positions after the target pad has been struck from either side.

U.S. Pat. No. 4,662,630, issued May 5, 1987 to Michael J. Dignard and Paul C. Roberts, and PCT Application Publication Number WO 94/11068, disclose wall mounted martial arts practice devices having resilient target members adapted to be struck from either side which may be mounted at varying heights on a wall attached member. In order to allow the target member to flex, the device of Dignard et. al. relies on a pair of springs connecting the target member and the wall attached member while in the device disclosed in the PCT Publication the target member is itself constructed of a flexible and resilient material.

U.S. Pat. Nos. 4,093,212, issued Jun. 6, 1978 to Ronald Harmon Jacques, and 5,464,377, issued Nov. 7, 1985 to Stephen E. Beeman, disclose wall mounted striking pad assemblies which rotatably support the striking pads and utilize spring assemblies to return the striking pads to their original positions. The device of Jacques is adapted to receive an upwardly directed blow while the device of Beeman is adapted to receive a blow directed at either of its sides.

U.S. Pat. No. 1,007,311, issued Oct. 31, 1911 to Arthur Aubriot Pons discloses a device having a striking pad resiliently supported by a stiff helical spring. The spring is mounted vertically on a stand that may include a spring encircling ring to cause the striking pad to rebound quickly.

U.S. Pat. Nos. 1,199,278, issued Sep. 26, 1916 to William R. Koch, and 4,807,871, issued Feb. 28, 1989 to Eric C. Bryson, disclose devices having target pads mounted on pivoting arms that provide resistance to the force of a blow delivered to the target pad by a user. In both of the above mentioned devices, the pivoting arms are connected to weights by a wire and pulley system to provide the means of resisting the force of a blow.

Soviet Patent Number 1,694,167, issued Nov. 30, 1991, discloses a martial arts training device having a pair of pivoting arms with target pads on the ends thereof. The device provides an angled frame on which a user is to stand when striking the target pads to increase the degree of difficulty in striking the pads and to simulate a more realistic fighting situation.

U.S. Pat. No. 5,509,875, issued Apr. 23, 1996 to Massimo Moretti, discloses a martial arts training device having a target pad mounted on a vertical arm extending from a mechanized base. The mechanized base moves the arm when the proximity or movement of a user is detected so that the user must attempt to strike a moving target.

U.S. Pat. No. 4,319,748, issued Mar. 16, 1982 to Efim Alter, European Patent Office document number 557,264, and Soviet Patent Number 1,655,524, disclose martial arts training devices having a plurality of moving arms which the user must attempt to strike while attempting to avoid being struck by the moving arms.

U.S. Des. Pat. No. 356,127, discloses a decorative design for a martial arts training device having a plurality of target pads supported in various positions on a vertically disposed pole.

However, none of the prior art discloses a martial arts training device having an arm adapted to support a hand held focus pad in a number of incremental positions over a resilient pivoting base.

None of the above inventions and patents, taken either singly or in combination, is seen to describe the instant invention as claimed.

SUMMARY OF THE INVENTION

The present invention relates to a martial arts practice apparatus which supports a common hand held striking target, called a focus pad, in a variety of positions corresponding to parts of a person's body. The apparatus generally comprises an arm adapted to hold a focus pad by its distal end and a base which pivotally supports the arm. An axle disposed through the middle of the base and the bottom end of the arm allows the arm to be pivoted in the base. A removable pin may be inserted through the arm and one of the holes formed at regular intervals through the top edge of the base at a uniform radial distance from the axle to secure the arm in a fixed position.

When a focus pad is secured in the distal end of the arm and struck by a user, the base of the apparatus flexes to absorb the force of the blow and returns quickly to position. This is achieved in the first embodiment of the present invention by constructing the top portion of the base of a resilient and flexible material that bends and returns to position when the focus pad is struck. In the second embodiment of the present invention this is achieved by pivotally securing the top portion of the base to the bottom portion of the base and attaching a pair of springs to the opposite sides of the base. The springs absorb the force of the blow and return the base to its original position after the focus pad has been struck.

Accordingly, it is a principal object of the invention to provide a martial arts training apparatus adapted to support a common hand held striking target.

It is another object of the invention to provide a martial arts training apparatus which resiliently flexes to absorb the force of the blows delivered to a focus pad held therein.

It is a further object of the invention to provide a martial arts training apparatus which supports a common hand held striking target at the end of an adjustably positioned elongate arm.

Still another object of the invention is to provide a martial arts training apparatus which relies on an axle and pin assembly disposed through its base to pivotally support an arm adapted to have a striking target secured therein in a number of incremental positions over the base.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
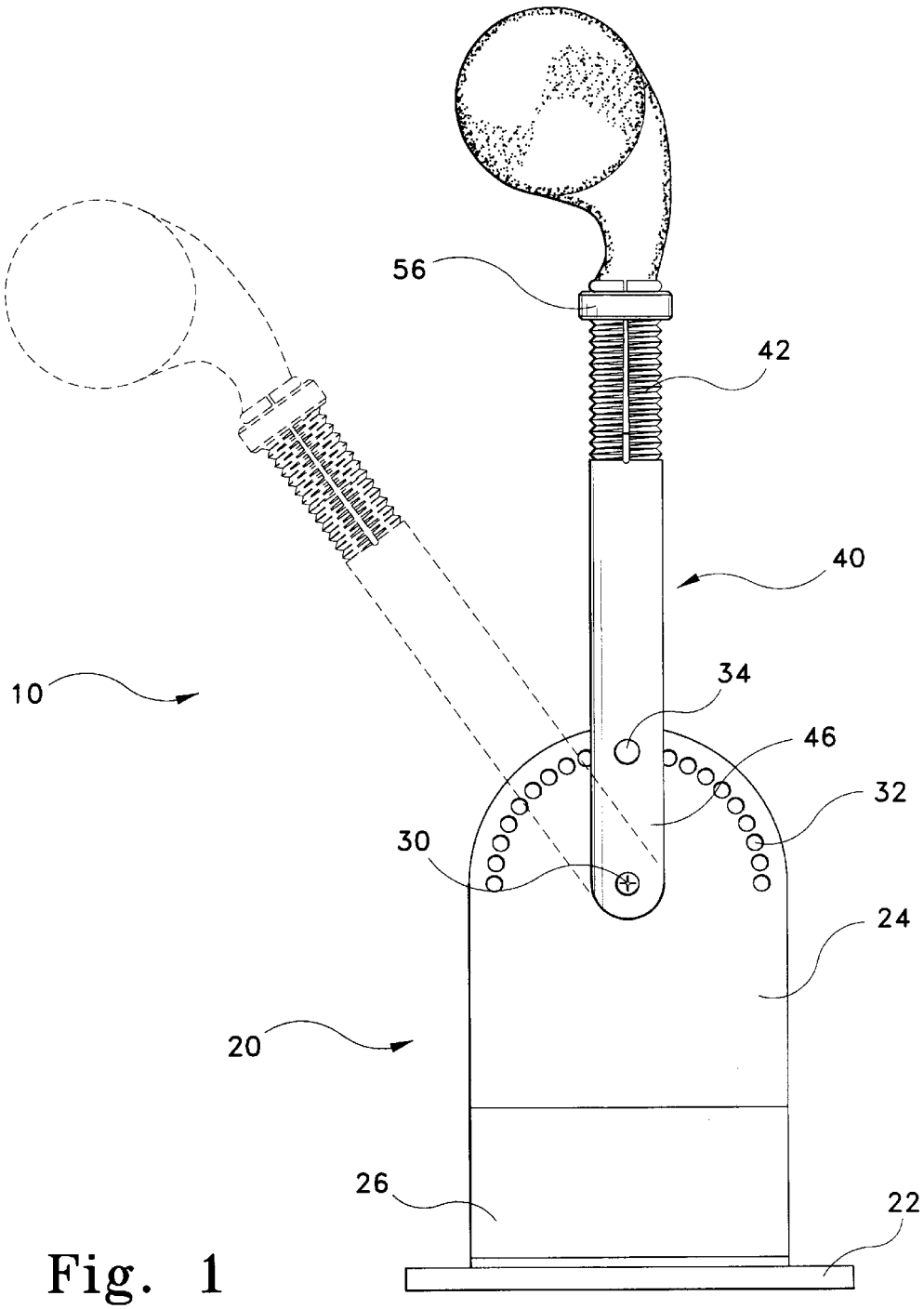
FIG. 1 is a front view of the focus pad holder of the present invention showing an alternate position in dashed lines.

Referring to the drawings, FIG. 1 illustrates the first embodiment of the martial arts training device 10 of the present invention which is adapted to support a common hand held striking target, often called a focus pad A, in a variety of positions. The martial arts training device 10 generally comprises an arm 40 adapted to hold a focus pad A and a base 20 which pivotally supports the arm 40.

The base 20 includes a bottom portion 22 forming a rectangular plate adapted to be mounted on a floor, wall, or ceiling, and top portion 24 extending upwardly therefrom. In the first embodiment, the top portion 24 is made of a resilient material that is formed into a flat plate having a semicircular top edge. The top portion 24 is mounted on the bottom portion 22 of the base 20 with a pair of right angled connecting plates 26.

The top portion 24 of the base 20 has an axle 30 disposed therethrough at the radial center of the semicircle formed by its top edge and a plurality of pin holes 32 which are adapted to receive a removable pin 34. The pin holes 32 are formed through base 20 at a uniform radial distance from the axle 30 at regular intervals. The axle 30, pin holes 32, and pin 34, which can also be seen in FIG. 1, allow the top portion 24 of the base 20 to pivotally support the arm 40 in a manner to be described later.

The arm 40 forms an elongate hollow cylinder having a distal end 42 with a means for holding the handle of a focus pad A and having a proximal end 46 defining a slot 44 therethrough formed along the longitudinal axis of the arm 40. The width of the slot 44 is slightly greater than the thickness of the top portion 24 of the base 40 and the length of the slot 44 is greater than the distance from the axle 30 to the top edge of the top portion 24 of the base 20. This arrangement allows the arm 40 to be placed on the top portion 24 of the base 20 so that the top edge thereof is received by the slot 44 in the proximal end 46 of the arm 40. This arrangement can be seen in FIG. 2.

Figure 2:
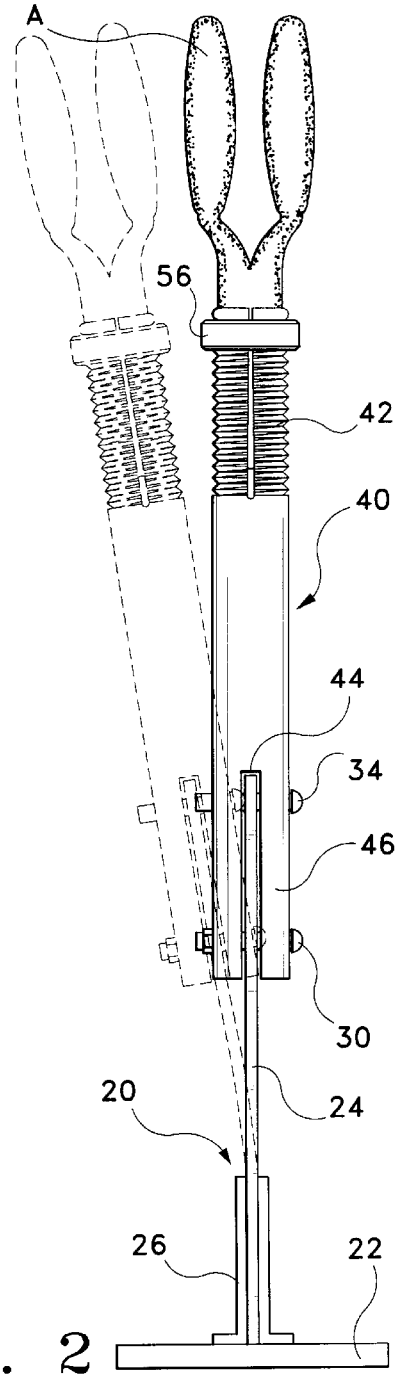
FIG. 2 is a side view of the focus pad holder of the present invention flexing from the force of a blow delivered to the focus pad.

As can also be seen in FIG. 2, this arrangement enables the axle 30 to be disposed through an axle hole (not shown) formed through the proximal end 46 of the arm 40 as well as through the top portion 24 of the base 20 so that the arm 40 is pivotally supported thereon. A pin hole (not shown) is formed through the proximal end 46 of the arm 40 in alignment with the pin holes 32 formed through the top portion 24 of the base. This allows the position of the arm 40 to be fixed by simply inserting the removable pin 34 through the pin hole formed through the arm 40 and one of the pin holes 32 formed through the top portion 24 of the base 20.

Figure 5:
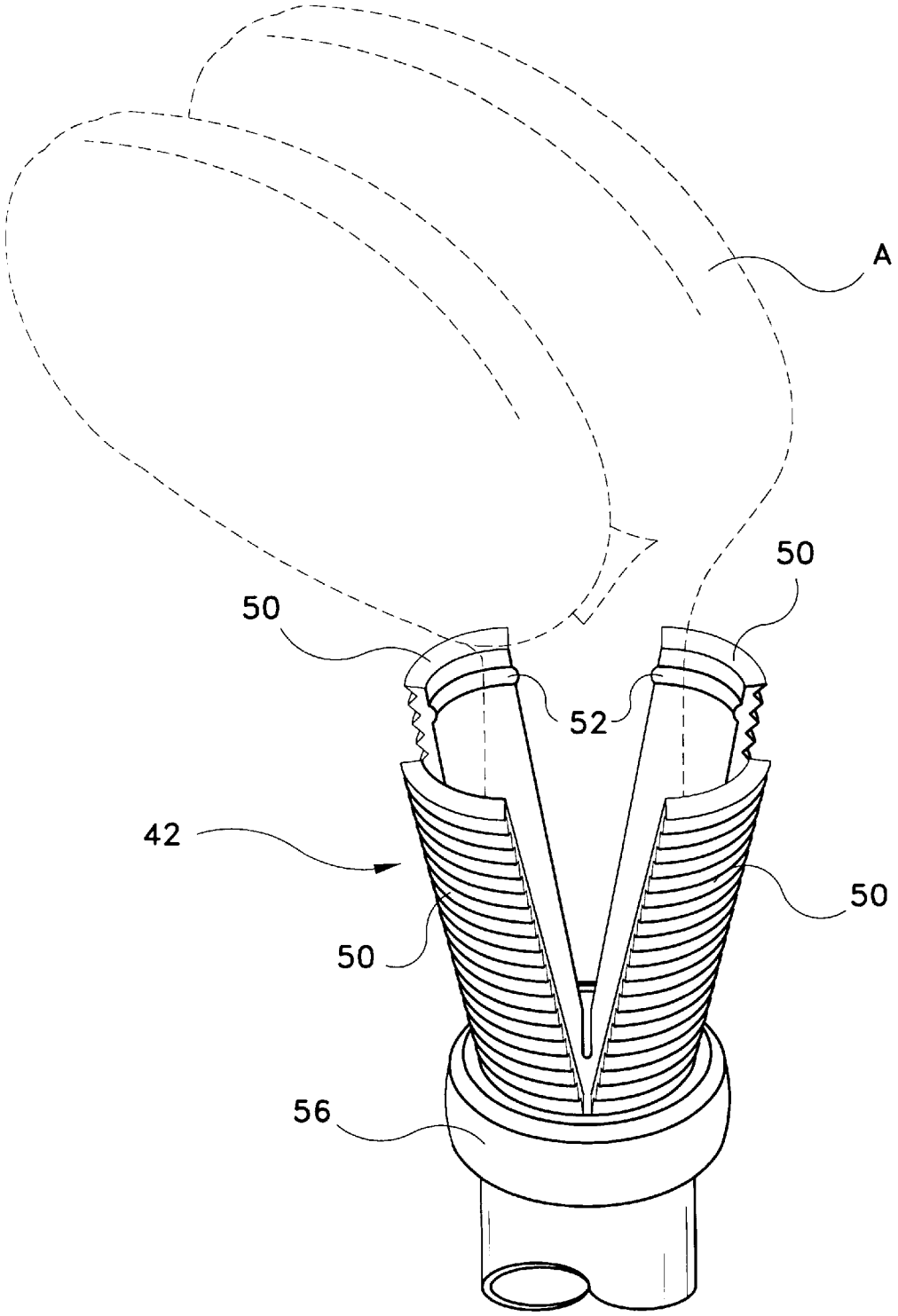
FIG. 5 is a perspective view of the focus pad grasping means of the present invention in a relaxed position.

After this has been done, the focus pad A may be secured into the distal end 42 of the arm 40. Typically, a focus pad is provided with a tubular handle. The distal end 42 of the arm 40 forms an externally threaded hollow cylinder defined by a plurality of arcuate sections 50 made of a flexible material for receiving this handle. The bottom of each arcuate section 50 is joined integrally with the arm 40 so that they may flex outward to receive the handle of the focus pad A. Each arcuate section 50 may also have a ridge 52 protruding from its inner surface. The ridges 52 collectively define a handle encircling ring on the inner surface of the distal end 42 of the arm 40, as illustrated in FIG. 5.

Figure 6:
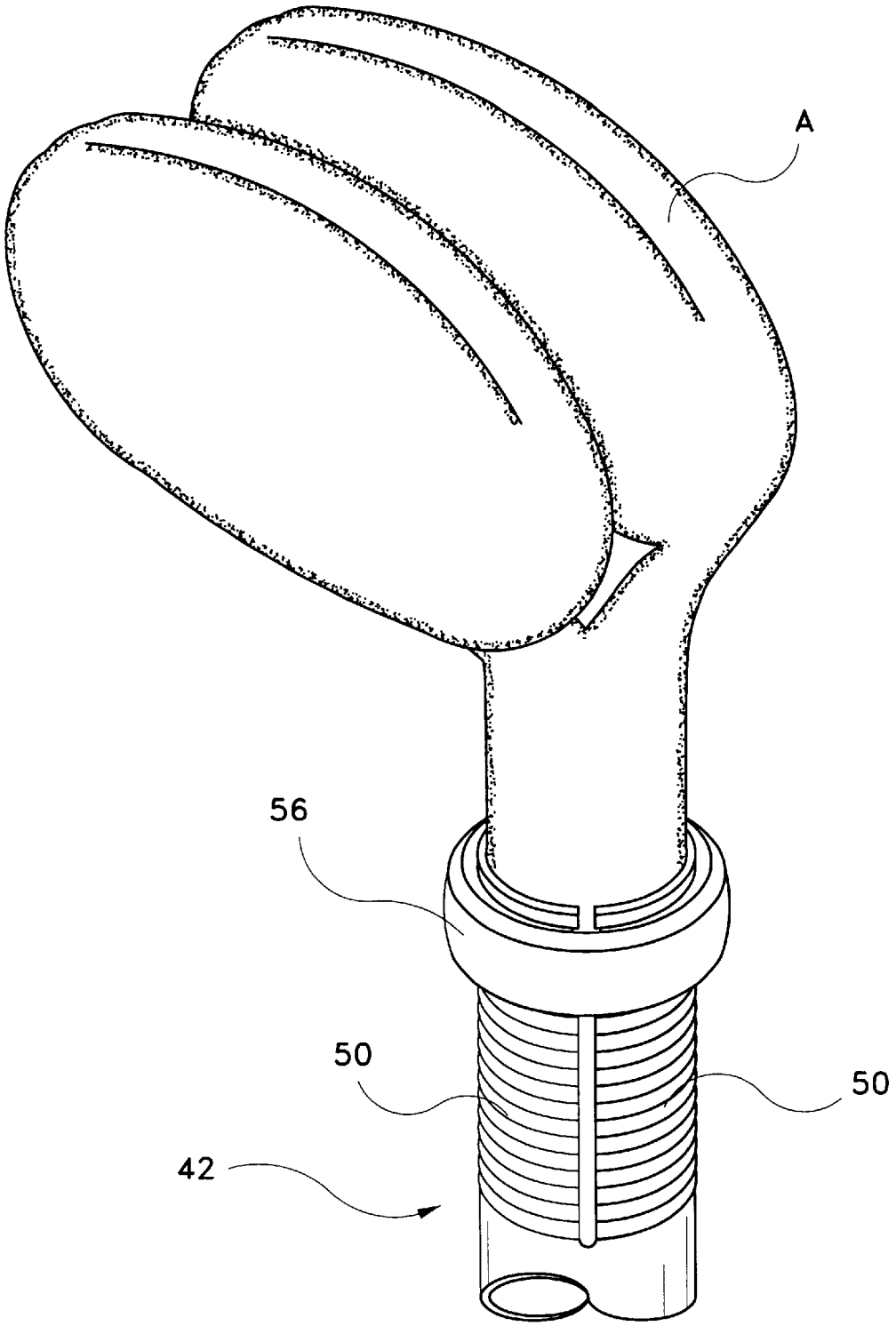
FIG. 6 is a perspective view of the focus pad grasping means of the present invention in use.
Figure 7A:
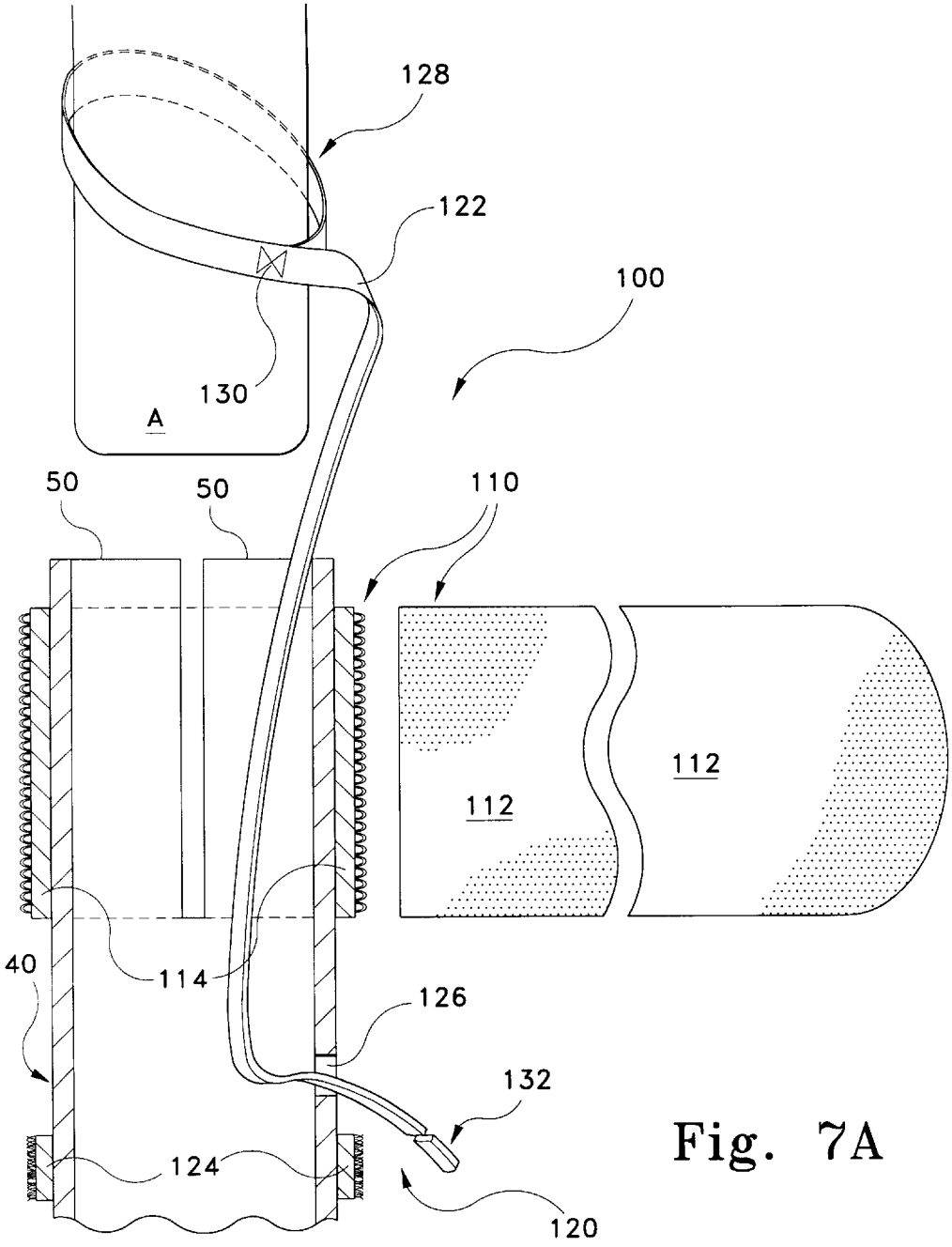
FIG. 7A is a partially exploded, sectional side view of a third embodiment of the present invention detailing an alternative means of attaching the focus pad.
Figure 7B:
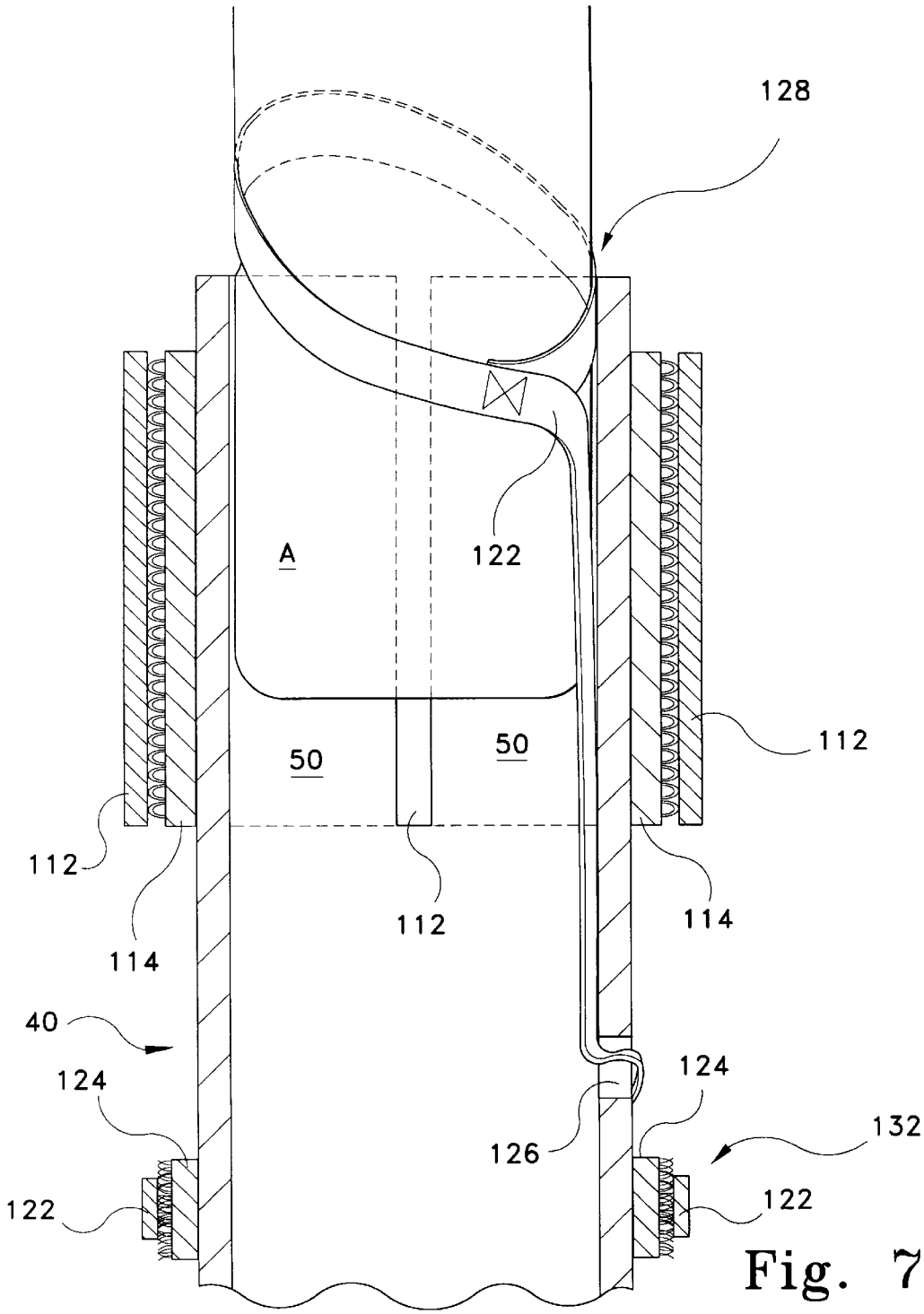
FIG. 7B is a sectional side view of a third embodiment of the present invention as shown in FIG. 7A, detailing the alternative means of attaching the focus pad in a state fully joined to the pad support arm.

In order to secure the focus pad A in place after it has been placed in the distal end 42 of the arm 40, an internally threaded ring 56 is disposed around the distal end 42 of the arm 40. When the ring 56 is threaded toward the top of the distal end 42 of the arm 40, the arcuate sections 50 and the ridges 52 thereon will be urged inward to clamp against the handle of the focus pad A. This is illustrated in FIG. 6. However, a preferred and more secure embodiment, as later described with reference to the third embodiment as shown in FIG. 7A and FIG. 7B may be substituted instead.

The focus pad A may now be struck by a user intent on improving their martial arts skills. When this is done, the top portion 24 of the base 20 will flex to absorb the force of the blow and then quickly return to position.

Figure 4:
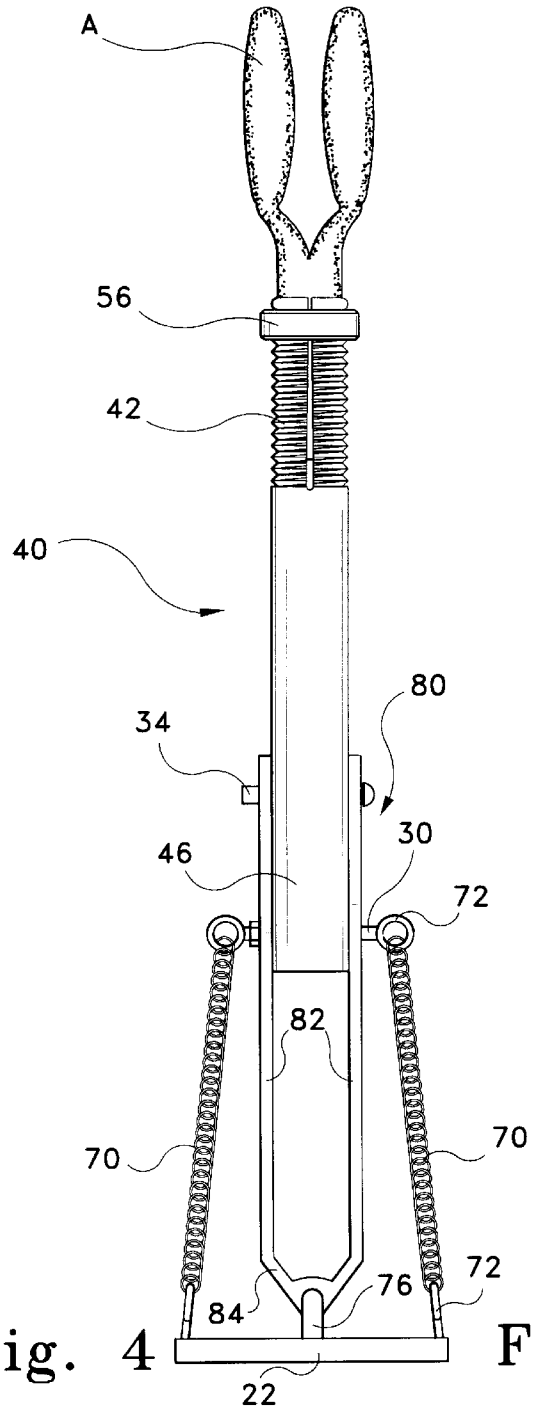
FIG. 4 is a side view of the second embodiment of the focus pad holder of the present invention having an alternate flexing means.

In the second embodiment of the present invention, the top portion 24 of the base 20 is replaced by a pivoting top portion 80 and a pair of springs 70 to provide the means for absorbing the force of a blow delivered to a focus pad A held in the distal end 42 of the arm 40. The pivoting top portion 80 is formed by two laterally spaced and substantially parallel plates 82 that are joined at their bottom ends by an axle receiving member 84. The plates 82 define a space adapted to receive the proximal end 46 of the arm 40 therebetween. This can be seen in FIG. 4.

Figure 3:
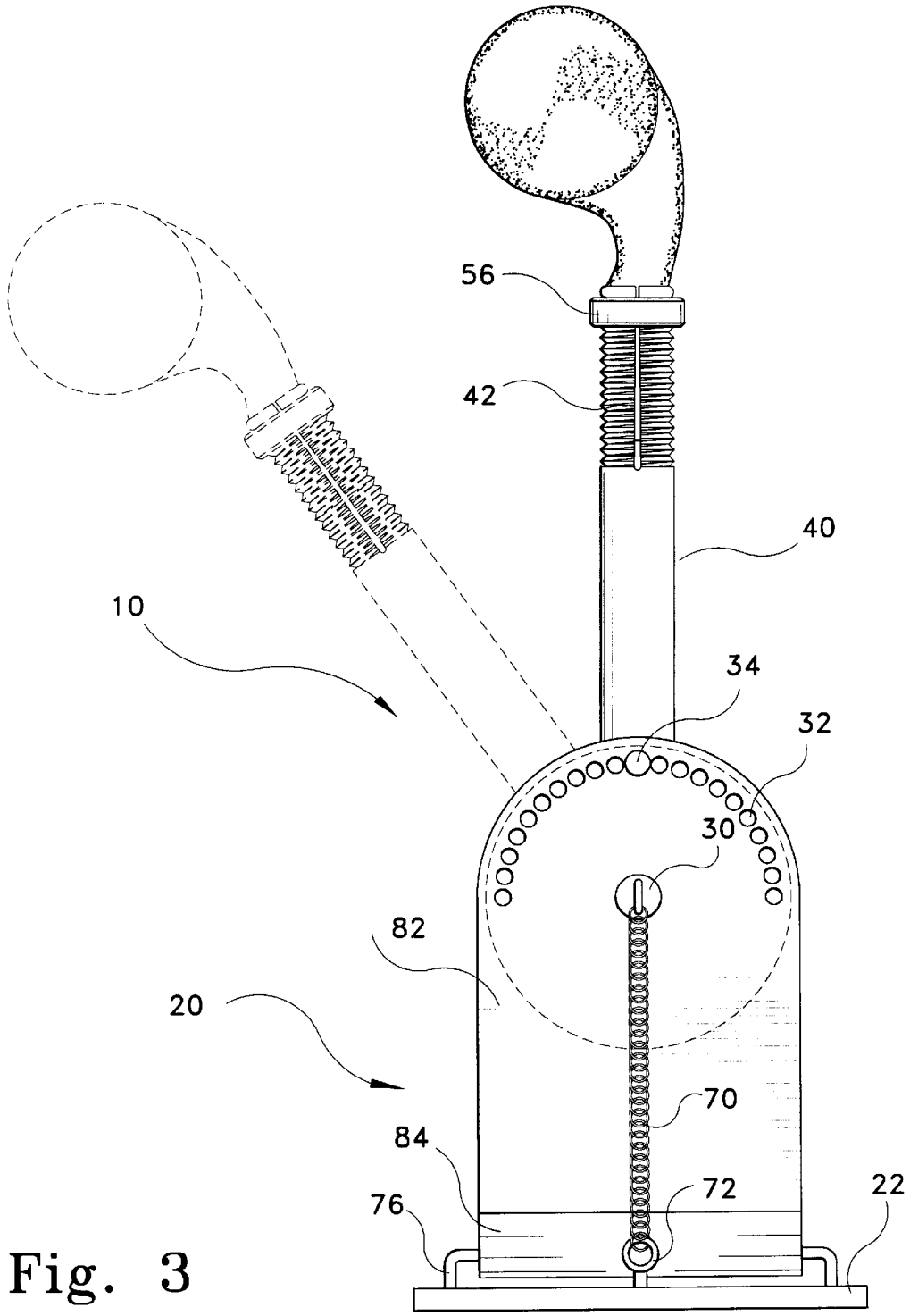
FIG. 3 is a front view of a second embodiment of the focus pad holder of the present invention having an alternate flexing means.

Each plate 82 of the pivoting top portion 80 has an axle hole (not shown) and a plurality of pin holes 32 formed therethrough in a configuration identical the that on the top portion 24 of the first embodiment, as is illustrated in FIG. 3. This allows the proximal end 46 of the arm 40 to be supported between the plates 82 by the axle 30 and pin 34 in a similar fashion to the first embodiment. However, since the proximal end 46 is now sandwiched between the plates 82, rather than being sandwiched around the top portion 24 of the first embodiment, the slot 44 is no longer required.

In order to allow the top portion 80 to pivot, the bottom portion 22 of the base 20 includes an axle 76 which is mounted over the top surface thereof and disposed through the axle receiving member 84. Additionally, a loop 72 is fixedly attached to the top surface of the bottom portion 22 of the base 20 on opposite sides of the axle 76 and to the outside of each plate 82 adjacent the axle 30. The loops 72 provide a means for attaching the top end of a spring 70 to each side of the pivoting top member 80 and for attaching the bottom end of a spring 70 to each side of the bottom portion 22 of the base 20. The springs 70 are equal in length and elasticity so that each spring 70 is tensioned equally when the pivoting top member 80 is in an upright position.

This arrangement allows the pivoting top member 80 to be resiliently supported in an upright position over the bottom member 22 by the springs 70. The force of a blow delivered to the focus pad A will cause the arm 40 and the pivoting top member 80 to pivot on the axle 76, thereby shortening one spring 70 and lengthening the other. In this position, the longer spring 70 will exert a greater force on the pivoting top member 80 than the shorter spring 70 to urge the pivoting top member 80 back into an upright position in which the force exerted on the pivoting top member 80 by each spring 70 is equal.

As noted above, a preferred means of attachment for securing the focus pad A in place onto arm 40 is also shown in FIG. 7A and FIG. 7B. In FIG. 7A, each component of the securing assembly 100 is shown individually, comprising a constricting mechanism 110 encircling the arm 40 about the arcuate sections 50 of the distal end 42, and a noosing assembly 120. As can be seen, the internally threaded ring 56 and associated threads of arm 40 of the previous embodiments are eliminated; however, the principle of urging the arcuate sections 50 inward to clamp against the handle of the focus pad A remains the same.

The constricting mechanism 110 comprises a hook and loop fastener, including first component 112 and second component 114, being a hook tape and a loop tape. The second component 114 of the constricting mechanism 110 is firmly affixed to the arcuate sections 50 of the arm. The first component 112 is a strap of indeterminant length, allowing the first component 112 to be wrapped tightly around the arm 40, thereby compressing the arcuate members 50 after the focus pad A has been inserted into the arm 40.

However, as a backup measure to further secure the focus pad A within the arm 40, the noosing assembly 120 is also provided. The noosing assembly 120 also comprises a hook and loop fastener, including first component 122 and second component 124, being a hook tape and a loop tape. Like the first component 112, the first component 122 is shown broken in FIG. 7A to indicate indefinite length. The second component 122 is a strap of substantial length, terminating at a noosing end 128 formed by a loop of a fixed diameter, made for example by taking a free end of the strap and sewing it at 130. The noosing end 128 enables snaring of the handle of the focus pad A as shown in FIG. 7A. The noosing assembly 120 is further defined by arm 40 which includes an aperture 126 sized to easily permit passage of a free end 132 of first component 122. The opposing free end 132 is provided to allow a user to grasp and exert force upon the noosing end 128 after insertion of focus pad A into arm 40, as explained below. The second component 124 is a band firmly affixed to the arm 40 just below the aperture 126.

Prior to insertion, the free end 132 is passed through aperture 126. The noosing end 128 is slipped over the handle of the focus pad A. The handle is then inserted into the arm 40 during which tension is exerted by the user upon the free end 132 of the first component 122. As seen in FIG. 7B, this force exerts pressure against the handle and causes it to slightly deform, as it is intended to do, thereby grasping it firmly. Under such tension, the free end 132 is then secured to the mating second component 124 of arm 40. Likewise, the strap-like first component 112 of the constriction mechanism 110 is also tightly wrapped about the arcuate members 50 to cause tightening upon the handle of the focus pad A. Together, the constriction mechanism 110 and noosing assembly 120 provide a very secure attachment means against the battering which the focus pad A endures under practice conditions Thus, the martial arts training device 10 of the present invention makes it possible for a single individual to practice his or her martial arts skills without the participation of a partner. The present invention provides both a method and an apparatus that allows a practitioner of the martial arts to conveniently and efficiently improve his or her proficiency in the martial arts. It should be understood by those skilled in the art that various modifications and adaptations as well as alternative embodiments may be contemplated.

It is to be understood that the martial arts training device 10 of the present invention is not limited to the embodiments described above, but encompass any and all embodiments within the scope of the following claims. The preferred embodiments of the present invention disclosed herein are intended to be illustrative only and are not intended to limit the scope of the invention.

I claim:

1. A martial arts practice device adapted to hold the handle of a hand held striking target, comprising:

an elongated arm having a proximal end and a distal end defining a longitudinal axis therebetween, said distal end of said arm having a means for holding the handle of a hand-held striking target, said arm having an axle hole formed therethrough adjacent the proximal end thereof perpendicular to the longitudinal axis thereof, said arm having a pin hole formed therethrough between said axle hole and said distal end of said arm;

a base having a top portion and a bottom portion supporting said top portion, said top portion of said base having an axle hole formed therethrough and a plurality of pin holes formed therethrough at a uniform radial distance from said axle hole equal to the distance between said axle hole and said pin hole formed through said arm, said top portion being constructed of a resilient material formed into a flat plate extending upward from the bottom portion of said base for absorbing the force of a blow delivered to the striking target, said flat plate having a semicircular top edge with a radial center disposed at said axle hole;

said arm further having a slot adapted to receive the top portion of said base, said slot extending from the proximal end to a point between said pin hole and the distal end, said slot being aligned with the longitudinal axis of said arm and having a length slightly greater than the distance between said top edge of said top portion of said base and said axle hole formed therethrough;

an axle disposed through said axle hole formed in said top portion of said base and through said axle hole formed in said arm, said axle being adapted to pivotally support said arm on said top portion of said base; and a pin adapted to be removably inserted through one of said pin holes formed through said top portion of said base and said pin hole formed in said arm to thereby secure said arm in a fixed position.

2. A martial arts practice device adapted to hold the handle of a hand held striking target, comprising:

an elongated arm having a proximal end and a distal end defining a longitudinal axis therebetween, said distal end of said arm having a means for holding the handle of a hand-held striking target, said arm having an axle hole formed therethrough adjacent the proximal end thereof perpendicular to the longitudinal axis thereof, said arm having a pin hole formed therethrough between said axle hole and said distal end of said arm;

a base having means for resiliently absorbing the force of a blow delivered to the striking target, said base including a top portion and a bottom portion supporting said top portion said top portion of said base having an axle hole formed therethrough and a plurality of pin holes formed therethrough at a uniform radial distance from said axle hole equal to the distance between said axle hole and said pin hole formed through said arm, wherein said top portion of said base is formed by two laterally spaced substantially parallel plates, said plates having a top end and a bottom end, said bottom ends of said plates being joined by an axle receiving member formed integrally thereon, said plates defining a space adapted to receive said proximal end of said arm therebetween;

wherein said bottom portion of said base has an axle mounted thereon, said axle being disposed through said axle receiving member of said top portion of said base; and wherein said tensioned springs each have a top end and a bottom end, said top ends of said tensioned springs being attached to opposed sides of said top portion of said base adjacent said axle disposed therethrough, said bottom ends of said tensioned springs being attached to said bottom portion of said base on opposite sides of said axle mounted thereon;

an axle disposed through said axle hole formed in said top portion of said base and through said axle hole formed in said arm, said axle being adapted to pivotally support said arm on said top portion of said base; and a pin adapted to be removably inserted through one of said pin holes formed through said top portion of said base and said pin hole formed in said arm to thereby secure said arm in a fixed position.

3. The martial arts practice device according to claim 1 wherein said distal end of said arm forms an externally threaded hollow cylinder defined by a plurality of arcuate sections, each of said arcuate sections having a top end and a bottom end, said bottom ends of each of said arcuate sections being joined integrally with said arm, each of said arcuate sections being adapted to flex outwardly to receive the handle of the hand held striking target; and wherein said distal end of said arm has an internally threaded ring adapted to be placed therearound, said ring being adapted to urge each of said arcuate sections inward when said ring is threaded upward from a position adjacent said bottom ends of said arcuate sections to a position adjacent said top ends of said arcuate sections to thereby cause the handle of the hand held striking target to be clamped therebetween.

4. The martial arts practice device according to claim 3 wherein each of said arcuate sections has an internal surface and an external surface, said internal surface of each of said arcuate sections having a ridge protruding therefrom adjacent said top ends thereof, said ridges collectively defining a ring adapted to encircle the handle of the hand held striking target when said ring is threaded upward to a position adjacent said top ends of said arcuate sections.

5. The martial arts practice device according to claim 1 wherein said distal end of said arm forms a hollow cylinder defined by a plurality of arcuate sections, each of said arcuate sections having a top end and a bottom end, said bottom ends of each of said arcuate sections being joined integrally with said arm, each of said arcuate sections being adapted to flex inwardly;

a hook and loop fastener comprising a first portion and a mating second portion, the first portion comprising a strap of a sufficient length to wrap at least once about the circumference of said arm, and the second portion affixed to said arcuate portion;

whereby when said first portion is tightly wrapped upon said second portion, each of said arcuate sections are urged inward thereby causing the handle of the hand held striking target to be clamped therebetween.

6. The martial arts practice device according to claim 5 wherein said distal end of said arm defines an aperture below said second portion of said arcuate section; and further comprising a a hook and loop fastener comprising a first portion and a mating second portion, the first portion comprising a strap having a noosing end formed by a loop and a free end of a sufficient length to wrap at least once about the circumference of said arm while said noosing end is positioned about the handle of said focus pad, and the second portion affixed to said arm proximate said aperture.

7. The martial arts practice device according to claim 2 wherein said distal end of said arm forms an externally threaded hollow cylinder defined by a plurality of arcuate sections, each of said arcuate sections having a top end and a bottom end, said bottom ends of each of said arcuate sections being joined integrally with said arm, each of said arcuate sections being adapted to flex outwardly to receive the handle of the hand held striking target; and wherein said distal end of said arm has an internally threaded ring adapted to be placed therearound, said ring being adapted to urge each of said arcuate sections inward when said ring is threaded upward from a position adjacent said bottom ends of said arcuate sections to a position adjacent said top ends of said arcuate sections to thereby cause the handle of the hand held striking target to be clamped therebetween.

8. The martial arts practice device according to claim 7 wherein each of said arcuate sections has an internal surface and an external surface, said internal surface of each of said arcuate sections having a ridge protruding therefrom adjacent said top ends thereof, said ridges collectively defining a ring adapted to encircle the handle of the hand held striking target when said ring is threaded upward to a position adjacent said top ends of said arcuate sections.

9. The martial arts practice device according to claim 2 wherein said distal end of said arm forms a hollow cylinder defined by a plurality of arcuate sections, each of said arcuate sections having a top end and a bottom end, said bottom ends of each of said arcuate sections being joined integrally with said arm, each of said arcuate sections being adapted to flex inwardly;

a hook and loop fastener comprising a first portion and a mating second portion, the first portion comprising a strap of a sufficient length to wrap at least once about the circumference of said arm, and the second portion affixed to said arcuate portion;

whereby when said first portion is tightly wrapped upon said second portion, each of said arcuate sections are urged inward thereby causing the handle of the hand held striking target to be clamped therebetween.

10. The martial arts practice device according to claim 9 wherein said distal end of said arm defines an aperture below said second portion of said arcuate section; and further comprising a a hook and loop fastener comprising a first portion and a mating second portion, the first portion comprising a strap having a noosing end formed by a loop and a free end of a sufficient length to wrap at least once about the circumference of said arm while said noosing end is positioned about the handle of said focus pad, and the second portion affixed to said arm proximate said aperture.

* * * * *